US006543875B2

(12) United States Patent
Gomez et al.

(10) Patent No.: US 6,543,875 B2
(45) Date of Patent: Apr. 8, 2003

(54) METHOD AND APPARATUS FOR REPORTING PRINTER COMPONENT STATUS

(75) Inventors: Jordi M. Gomez, San Diego, CA (US); Jose M. Rio Doval, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/835,805

(22) Filed: Apr. 16, 2001

(65) Prior Publication Data

US 2002/0149640 A1 Oct. 17, 2002

(51) Int. Cl.[7] ..... B41J 2/165
(52) U.S. Cl. ..... 347/23; 347/108; 346/17
(58) Field of Search ..... 347/23, 22, 108; 346/17

(56) References Cited

U.S. PATENT DOCUMENTS 6,070,960 A * 6/2000 Nakajima ..... 347/29
6,364,448 B2 * 6/2000 Nishioka et al. ..... 347/23

* cited by examiner

*Primary Examiner*—Craig Hallacher

(57) ABSTRACT

A method and apparatus for servicing a printer which has a processor and a display includes a component having circuitry for communicating a status of the component, where the processor, coupled to the component, further includes second circuitry for determining a service requirement for the component in response to analyzing the status of the component. Also included is an indicator, observable by a user performing the service at least when the display is not observable by the user, for indicating the service requirement to the user. The indicator may be included with the particular component, and may be a visual and/or an audible indicator.

20 Claims, 10 Drawing Sheets

METHOD AND APPARATUS FOR REPORTING PRINTER COMPONENT STATUS

FIELD OF THE INVENTION

This invention relates to printers, and in particular to a method and apparatus for reporting the status of a printhead in an inkjet printer.

BACKGROUND OF THE INVENTION

An ink jet printer is a non-impact printing device which forms characters and other images by ejecting ink droplets, in a controllable manner, onto printable media.

Over time, inkjet printing has become more sophisticated, and now provides the capability to print in any number of colors, to print complicated graphic designs, to utilize a vast number of different fonts, and to print photographs. An ink jet printer typically includes at least one of the following: an ink reservoir; a printhead; a printhead-cleaning device; a mechanism for positioning the printhead with respect to the media; a media handling mechanism; and, a processor for controlling printing operations. The printer may also include a front panel for allowing a user to interact with the printer.

The ink reservoir stores a quantity of ink for use by the printhead. The reservoir typically supplies black, cyan, magenta, and yellow inks which may be pigment based, dye based, paraffin based, as well as hybrid or composite based depending on the application. The reservoir may be located remotely from the printhead and may be connected by tubing or another suitable ink conduit for supplying ink to the printhead. The reservoir may alternatively be integrated with the printhead as a single assembly.

The printhead typically operates by ejecting ink droplets through nozzles onto the printing media. The printhead may utilize different techniques to accomplish this ejection. For example, in a thermal printhead, each nozzle includes a small chamber with an electrical heating element. Energizing the heating element causes the volume of ink present in the chamber to vaporize and to be ejected through the nozzle. The printhead typically includes a large number of nozzles which are individually controlled to form desired images on the media.

The printhead cleaning device is utilized to clean the printhead. The device typically includes a wiper, over which the printhead passes to wipe off any accumulated ink, ink residue, or fibers from the media which may collect on the printhead.

The printhead is usually mounted with other printheads in a carriage which moves back and forth to precisely position each printhead, and thus the nozzles of each printhead, with respect to the media. The carriage movement may be controlled by various positioning mechanisms. As an example, stepper motors may be used to guide the carriage along a rod or rods. The operation of the printhead positioning system may be coordinated with that of the media handling system to accurately place the ink drops on the media. The accuracy of the printhead positioning and media handling mechanisms is such that large format printers currently available are capable of printing 1200 dots per inch or more.

The media handling mechanism may include a series of rollers for advancing the media through the printer and for precisely positioning the media in coordination with the printhead positioning mechanism. A central platen is typically included to support the media during printing. Examples of printing media may include paper, acetate, cloth, etc.

For large format printers, also called plotters, there is a trend toward longer printing areas, and thus longer plotters, to accommodate wider media. At the present time plotters accommodating sixty inch wide media are commonly available. Another developing trend is an increase in the number of printheads per plotter. The number of ink compositions available for use is also proliferating in order to provide the number of colors and photographic quality desired by users. Correspondingly, the number of printheads present in a plotter to deliver these inks is also increasing. As the number of printheads increases, the number of reservoirs is also increasing, with a trend toward having one reservoir per printhead for increased ink capacity. An additional trend is an increase in the complexity and sophistication of the user interface. As software continues to play a larger role in the operation of a plotter, the user interface is becoming more complex and is capable of providing a user with increasing amounts of information about the system. However, due to display size constraints, this information may be initially displayed in an abbreviated format and details may only be available by traversing a number of screens.

On occasion, components of the plotter require adjustment, replacement, refilling, etc. These types of operations are referred to herein as service or service operations.

Several problems arise when a user is alerted that a component in the printer requires servicing. Because of the display constraints, the user may only receive an abbreviated message, and then must navigate through a series of screens to determine the problem and what type of servicing is required. If multiple components require different types of service at the same time, this navigation may be a tedious exercise and the user may be required to remember a large amount of information. Another problem is the distance a user may have to travel between the display and the component service area. The user may be required to move back and forth between the display and the component service area in order to obtain information and then perform the necessary service operations. In addition, the user may have to be able to distinguish which component needs service from a number of components that may be present in the same location.

Accordingly, it is an object of this invention to provide a method and apparatus for reporting various conditions of a particular printer component by utilizing indicators that allow a user to service the component without excessive movement between a display device and the component to be serviced.

It is another object of this invention to report various conditions of a particular printer component by utilizing indicators that are detectable by a user while the user is located proximate to the servicing area for a particular component.

It is still another object of this invention to provide for reporting various conditions of a particular printer component by utilizing indicators located proximate to the particular component.

SUMMARY OF THE INVENTION

A method and apparatus are disclosed for servicing a printer which has a processor and a display. The invention includes a component having circuitry for communicating a status of the component, where the processor, coupled to the component, further includes second circuitry for determining a service requirement for the component in response to analyzing the status of the component. Also included is an indicator, observable by a user performing the service at least when the display is not observable by the user, for indicating the service requirement to the user. The indicator may be included with the particular component, and may be a visual and/or an audible indicator.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
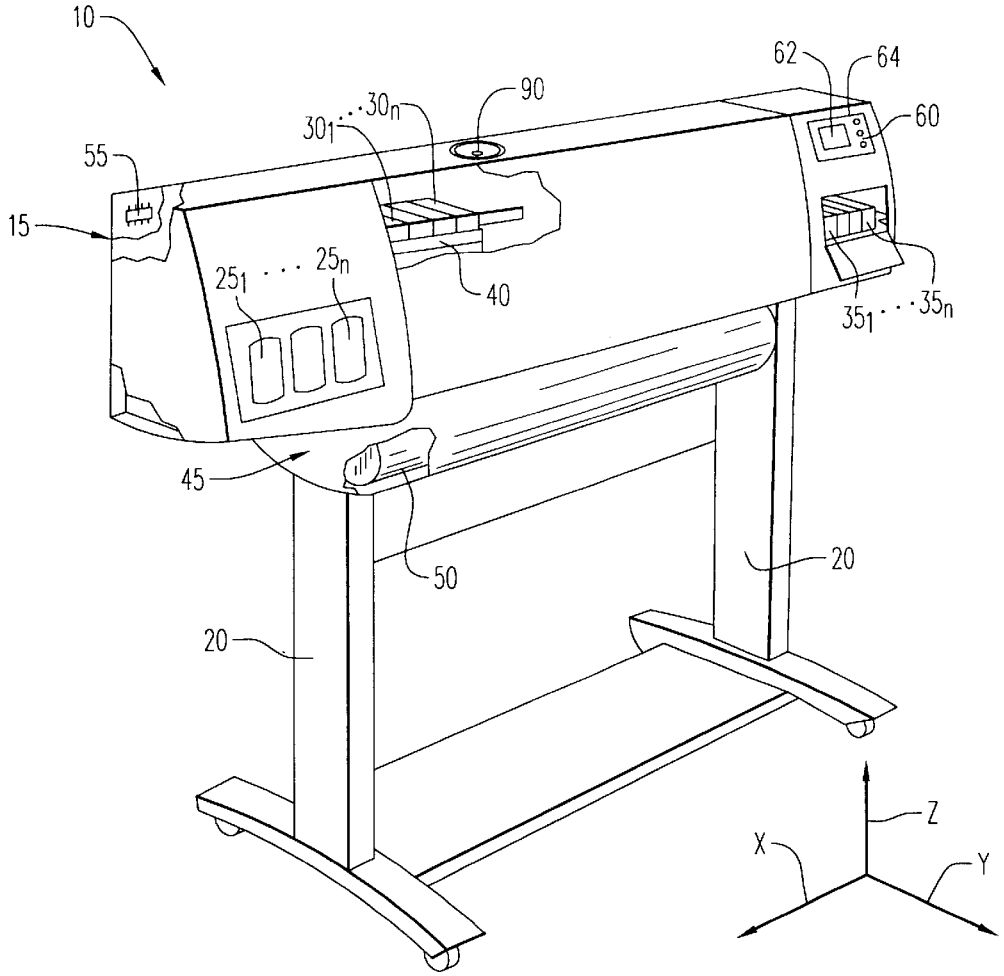
FIG. 1 is a perspective view of a plotter in accordance with the invention in cut-away form.

FIG. 1 illustrates an example of a large format inkjet printer, also called a plotter 10, in accordance with the present invention. Plotters are usually used for printing conventional engineering and architectural drawings, as well as high quality poster-sized images and the like, in an industrial, office, home, or other environment.

The plotter 10 may include a printing assembly 15 which is preferably supported by a pair of leg assemblies 20. The plotter 10 in this example utilizes at least one ink reservoir $\mathbf{25}_1$–$\mathbf{25}_n$ for each ink, supplying ink to a corresponding printhead $\mathbf{30}_1$–$\mathbf{30}_n$. The printheads $\mathbf{30}_1$–$\mathbf{30}_n$ are preferably mounted in a carriage 40 which operates to precisely position the nozzles of each printhead $\mathbf{30}_1$–$\mathbf{30}_n$ over the media 50. For each printhead $\mathbf{30}_1$–$\mathbf{30}_n$, there is preferably a printhead cleaning device $\mathbf{35}_1$–$\mathbf{35}_n$. A media handling mechanism 45 may be used to advance print media 50 through the plotter 10.

The plotter 10 may also include a processor 55, that receives image data and/or instructions from a host device, typically a computer, such as a personal computer or other type of computer system (not shown). The processor 55 directs the printing operations of the plotter 10. Each of the components may include circuitry or other means that allows communication with the processor 55 in order to identify and determine the status of the component.

The plotter 10 may also include a front panel 60 which provides a user interface by way of a display 62 and a keypad 64, where the display 62 provides information to the user and the keypad 64 accepts input from the user. A monitor (not shown) coupled to the host device may also be used to display visual information to an operator, such as printer status, service requirements, error conditions, etc.

Figure 2:
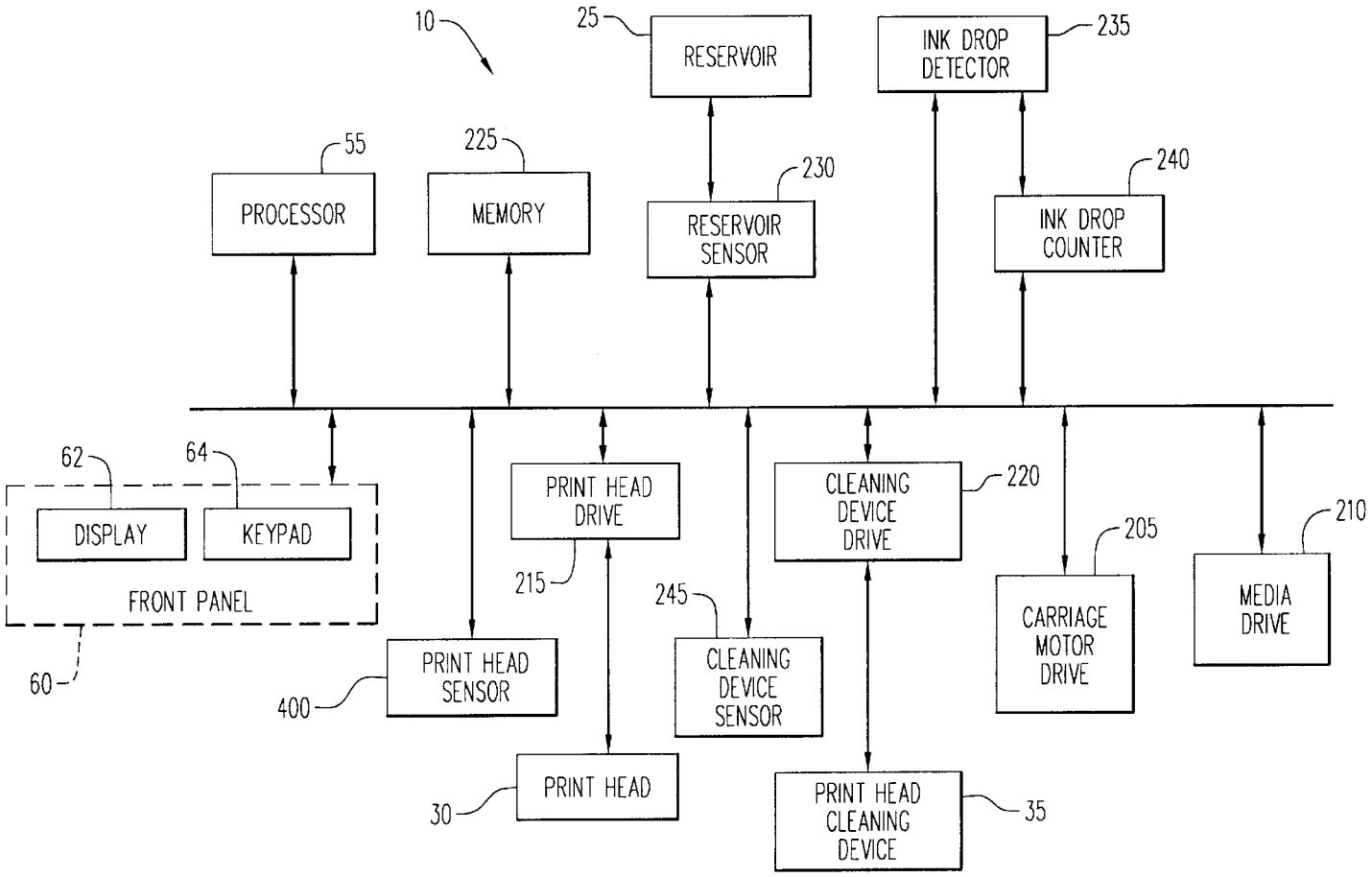
FIG. 2 is a block diagram of the plotter.

FIG. 2 shows a block diagram of plotter 10. Plotter 10 includes processor 55 for directing printer operations and front panel 60 including display 62 and keypad 64 for displaying messages to a user and receiving user inputs, respectively. The plotter 10 also includes a carriage motor drive 205 for positioning the carriage 40, a media drive 210 that operates to position the media 50, and a printhead drive 215 for controlling the individual nozzles on each printhead $\mathbf{30}_1$–$\mathbf{30}_n$. Printer 10 also includes a cleaning device drive 220 for positioning printhead cleaning devices $\mathbf{35}_1$–$\mathbf{35}_n$ and memory 225 for storing programs, including a printer operating system, temporary system operating parameters and temporary data.

The processor 55 executes the programs in memory 225 either automatically, in response to user inputs from front panel 60, or in response to inputs from the host device.

The plotter 10 also includes sensors for determining the status of certain components. Some examples of sensors are shown in FIG. 2. A reservoir sensor 230 may be provided to determine various characteristics of at least one of the reservoirs 25 including the amount of ink in that particular reservoir 25. An ink drop detector 235 may be used to determine if a nozzle actually ejects ink when directed. To determine the number of drops ejected, an ink drop counter 240 is used. The ink drop detector 235 and the ink drop counter 240 may be used in combination to determine if a printhead 30 is empty and/or has reached the end of its useful life. A printhead sensor 400 may record various aspects of the printhead 30 including electrical continuity and power supply voltages. A cleaning device sensor 245 may be used to determine if a spittoon, present as part of a particular printhead cleaning device 35, is full.

Each of the components, for example, the reservoirs $\mathbf{25}_1$–$\mathbf{25}_n$, printheads, $\mathbf{30}_1$–$\mathbf{30}_n$ and printhead cleaning devices $\mathbf{35}_1$–$\mathbf{35}_n$, may include circuitry for providing status information about the particular component.

The processor 55 also directs the performance of maintenance procedures and quality checks on a periodic basis. The processor 55 may be capable of testing various characteristics of the components and, based on the results of a test of a particular component, direct the performance of a maintenance procedure or quality check. For example, before starting a printing task, also known as a job, the processor 55 may query the reservoir sensor 230 to determine if there is enough of each required ink to complete the job. At this point several things may happen. As one example, the processor 55 may not be able to establish communication with a particular reservoir $\mathbf{25}_n$. In that case, the processor 55 may direct the user to remove and reseat the reservoir $\mathbf{25}_n$ in an attempt to ensure a proper electrical connection. As another example, the processor may determine that the reservoir $\mathbf{25}_n$ does not contain enough ink and may direct the user to replace or refill the reservoir $\mathbf{25}_n$.

As a further example of a maintenance or quality procedure, after a nozzle on printhead $\mathbf{30}_n$ has been energized a specified number of times, the processor 55 may direct the printhead $\mathbf{30}_n$ to pass over the printhead cleaning device $\mathbf{35}_n$ to wipe off the nozzle and then to fire the nozzle to ensure that it continues to emit ink properly. In the event that the ink drop detector 235 fails to detect a drop, the processor 55 may direct the user to clean or replace the printhead $\mathbf{30}_n$.

Additional examples of testing that may be performed on a particular component may include the following: A component presence check may be performed, where the presence of a component may be verified by accessing circuitry known to be present in the component. A power supply check may be performed to verify that the particular component is being supplied with the correct power and/or is not consuming an improper amount of power. A continuity check may be performed to ensure that a component is seated properly. A model check may be executed where the processor 55 verifies that the correct model of a particular component is installed. The functionality of circuitry included as part of the component may also be verified. Information related to the useful life or warranty life of a component may be tested to insure proper printing quality. The temperature of a component may be measured to ensure proper operating conditions. Information that may be stored in a memory device of the component may also be read to determine a particular characteristic of the component. Based on the results of these tests, the processor 55 may instruct a user to execute maintenance and/or quality procedures as may be required.

It should be understood that the processor 55 may direct maintenance and/or quality procedures for each component of the plotter 10, including the printhead-cleaning devices $\mathbf{35}_1$–$\mathbf{35}_n$, the media handling mechanism 45, and any other component of the plotter 10 that may be capable of being identified or controlled by the processor 55. Typical service operations may include any operation suitable for placing the plotter in operating condition and may further include replacing or refilling a reservoir $\mathbf{25}_1$–$\mathbf{25}_n$, reseating a reservoir $\mathbf{25}_1$–$\mathbf{25}_n$ that might not be seated correctly, cleaning or replacing a printhead $\mathbf{30}_1$–$\mathbf{30}_n$, reseating a printhead $\mathbf{30}_1$–$\mathbf{30}_n$, adjusting the alignment of the carriage 40, replenishing the media 50, adjusting the media handling mechanism 45, etc.

It can be seen from FIG. 1 that the various plotter components, in particular reservoirs $\mathbf{25}_1$–$\mathbf{25}_n$ and printheads $\mathbf{30}_1$–$\mathbf{30}_n$ may be remotely located from the front panel 60. Thus, in the event that a component requires servicing, a user may first have to consult the display 62 to determine which component requires attention and what service operation is required, and then move to the remotely positioned component to service the component. As mentioned above, if several components require different service operations, a user may be required to move back and forth several times between the display 62 and the particular component, may be required to distinguish the failing component from other components present in the same location, and may be required to remember a large amount of information.

Thus, it would be advantageous to provide a user with an indicator, observable to the user while the service operation is being performed, to indicate which component requires attention, and preferably to indicate the service procedure required.

Figure 3:
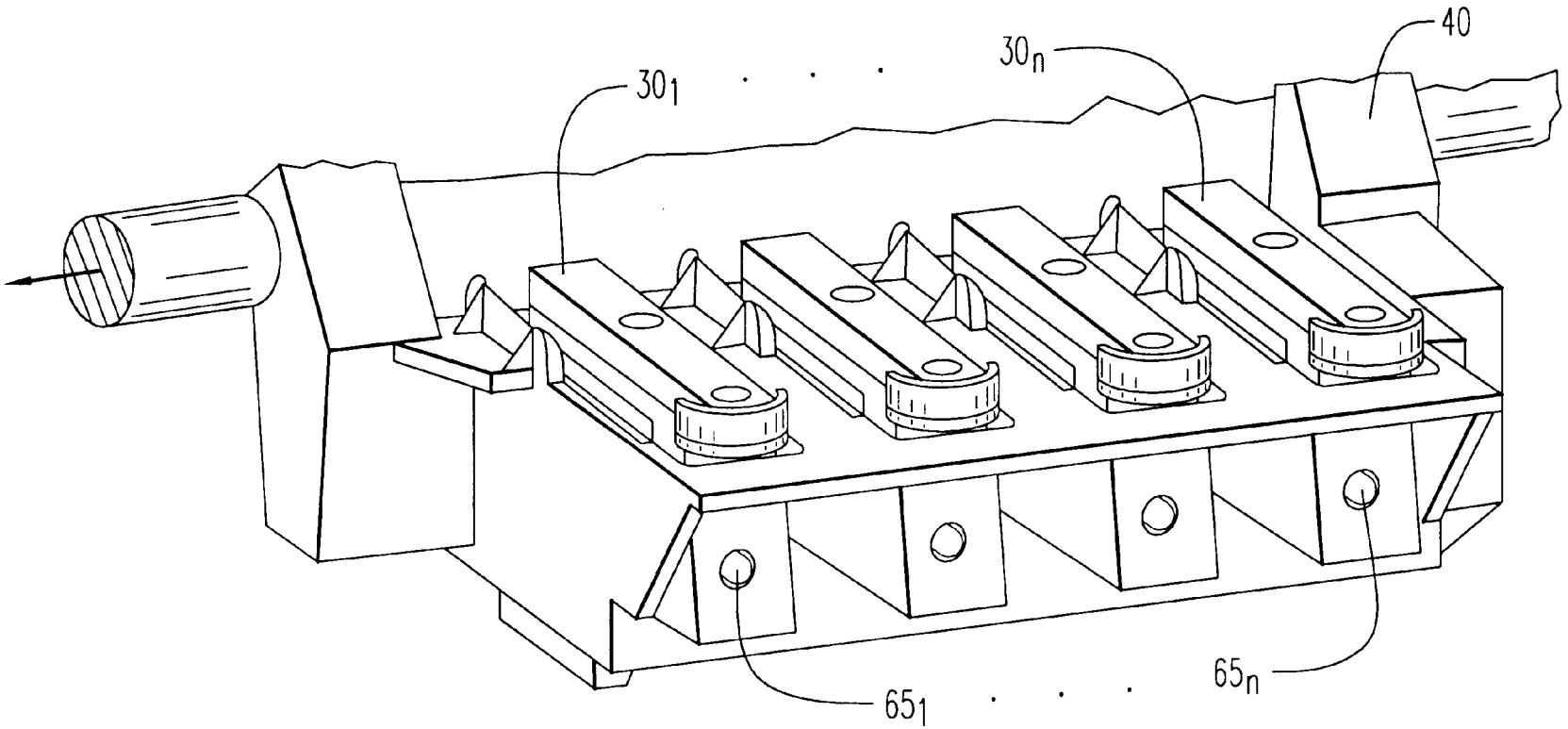
FIG. 3 shows a printhead including an indicator according to the teachings of the invention.

FIG. 3 shows an example of one embodiment of such an indicator. In FIG. 3, a detailed view of the printheads $\mathbf{30}_1$–$\mathbf{30}_n$ is depicted. In accordance with the teachings of this invention, each of the printheads $\mathbf{30}_1$–$\mathbf{30}_n$ includes an indicator $\mathbf{65}_1$–$\mathbf{65}_n$ for providing information to the user. Using printhead $\mathbf{30}_1$ as an example, indicator $\mathbf{65}_1$ is preferably a visual device, for example, a bicolor LED. Indicator $\mathbf{65}_1$ may emit one color, preferably red, to indicate that service is required for printhead $\mathbf{30}_1$, and may emit a different color, preferably green, to indicate that no service is required for printhead $\mathbf{30}_1$. The processor 55, in addition to alerting the user that service is required by way of the display 62, is also able to control the indicator $\mathbf{65}_1$ by electrical or other means in order to communicate the various conditions and service requirements to the user.

In another embodiment, indicator $\mathbf{65}_1$ may be a display, for example, a liquid crystal display, that may provide an indication to the user regarding whether or not the printhead $\mathbf{30}_1$ requires service, and may further provide detailed instructions regarding the service procedure.

Figure 4:
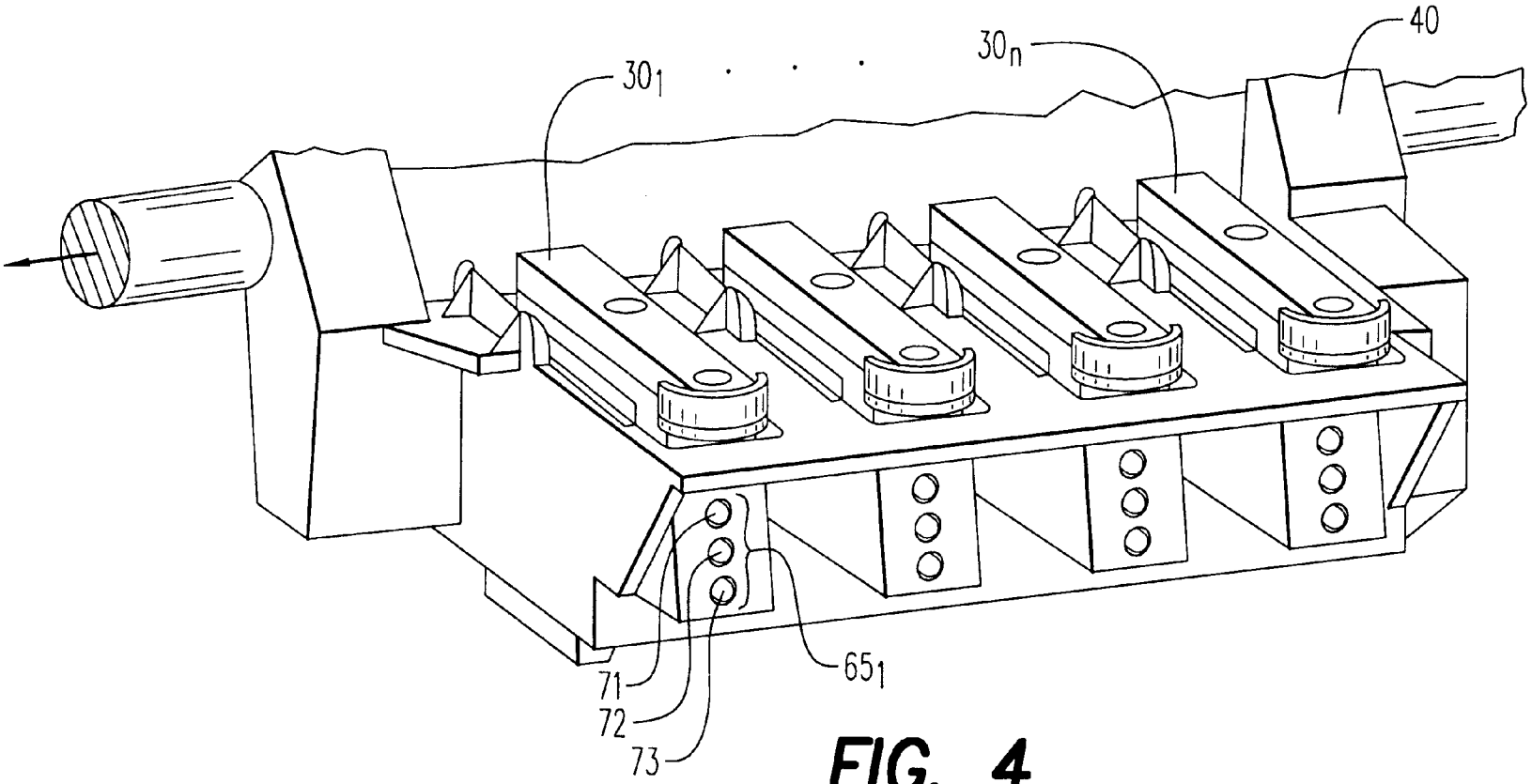
FIG. 4 shows a printhead where the indicator includes a number of LEDs.

In still another embodiment, indicator $\mathbf{65}_1$ may be made up of more than one LED 71, 72, 73, as shown in FIG. 4. LEDs 71, 72, 73 may light in a particular color, a set of colors, a pattern, may flash, or may otherwise illuminate to indicate that service is required for printhead $\mathbf{30}_1$. LEDs 71, 72, 73 may also illuminate in a manner that specifies the particular type of service operation to be performed. For example, LEDs 71, 72, 73 may all be red in the event that printhead $\mathbf{30}_1$ requires service, and may flash sequentially to indicate that the printhead $\mathbf{30}_1$ needs to be reseated. Once reseated, the LEDs may all turn green, indicating that the reseating action successfully cured the problem. It should be understood that indicators $\mathbf{65}_1$–$\mathbf{65}_n$ may include any number of LEDs suitable for providing the indications described herein.

Figure 5:
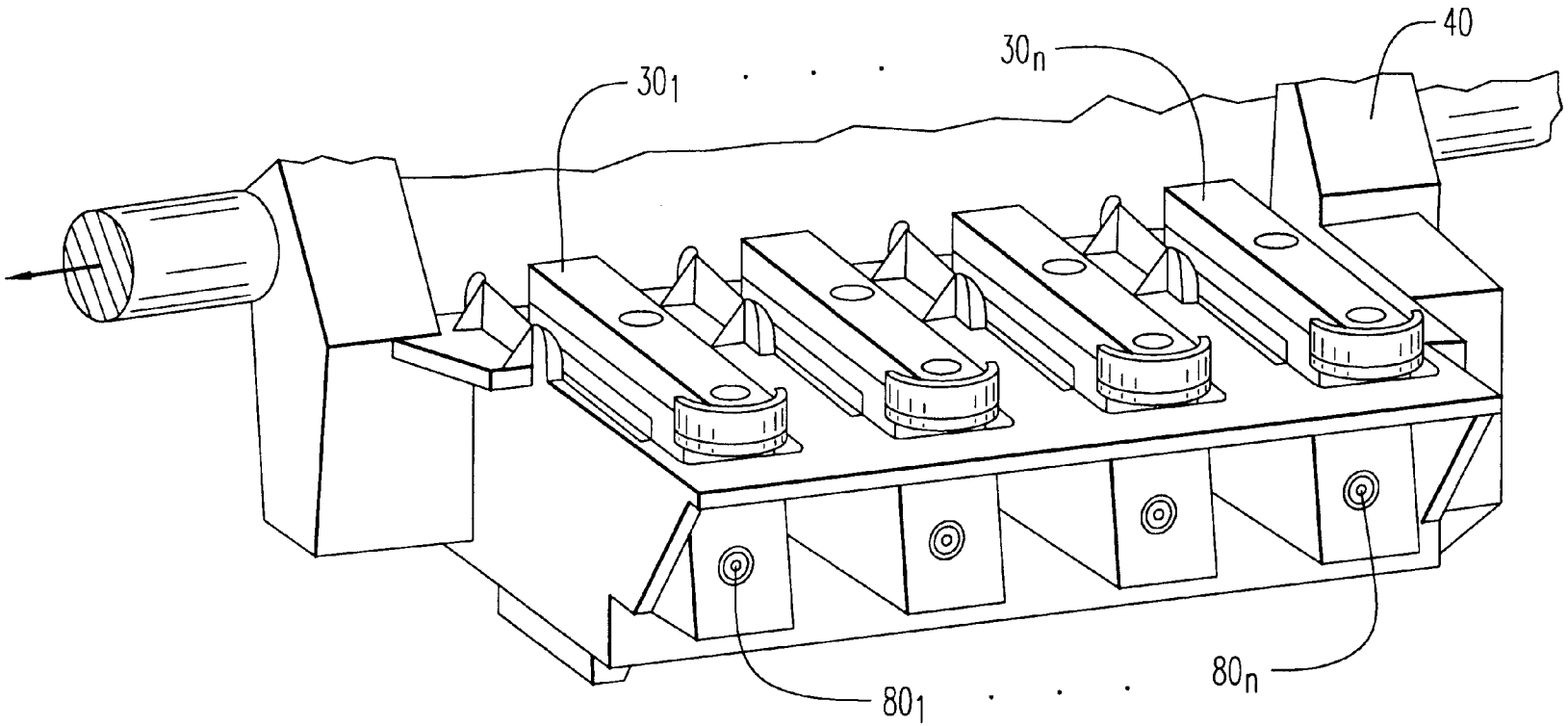
FIG. 5 shows an embodiment where the indicator is an audible indicator.

FIG. 5 shows another embodiment where the indicator $\mathbf{65}_1$ for printhead $\mathbf{30}_1$ is an audible indicator $\mathbf{80}_1$. The audible indicator may provide an indication that service is required by a single audible tone, or may provide a series of tones that may indicate not only that service is required but also the type of service operation that may need to be performed. The audible indication may not be limited to tones but may include any audible sound, including words or other vocal instructions. In a further embodiment, audible indicators $\mathbf{80}_1$–$\mathbf{80}_n$ may be implemented as a single audible indicator for a number of components. For example, returning to FIG. 1, a speaker 90 may be utilized to provide synthesized voice instructions to a user. Those instructions when displayed as text on display 62 might otherwise be unobservable when servicing the reservoirs $\mathbf{25}_1$–$\mathbf{25}_n$. The audible indicator $\mathbf{80}_1$ may also include a piezoelectric device or any device suitable for producing sound.

Figure 6:
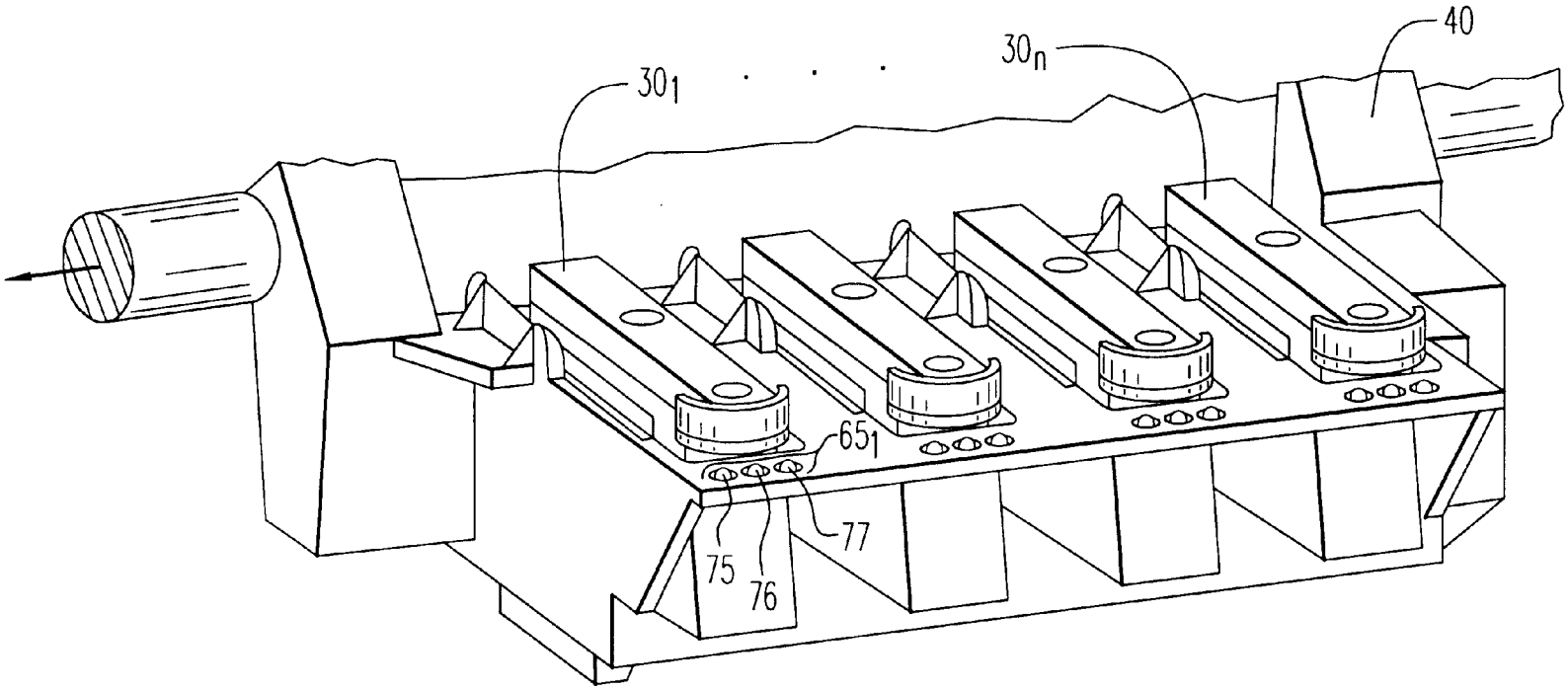
FIG. 6 shows an embodiment where the indicators are mounted on a printhead carriage.

FIG. 6 shows yet another example of an embodiment of indicator $\mathbf{65}_1$ where indicator $\mathbf{65}_1$ includes three LEDs 75, 76, 77 mounted on the carriage 40. It should be understood that the indicators $\mathbf{65}_1$–$\mathbf{65}_n$ may be located anywhere that is observable by the user when the user is performing service on a particular component, including areas in close proximity to the component, covers, support structures, carriers, or other parts of the plotter 10.

Figure 7:
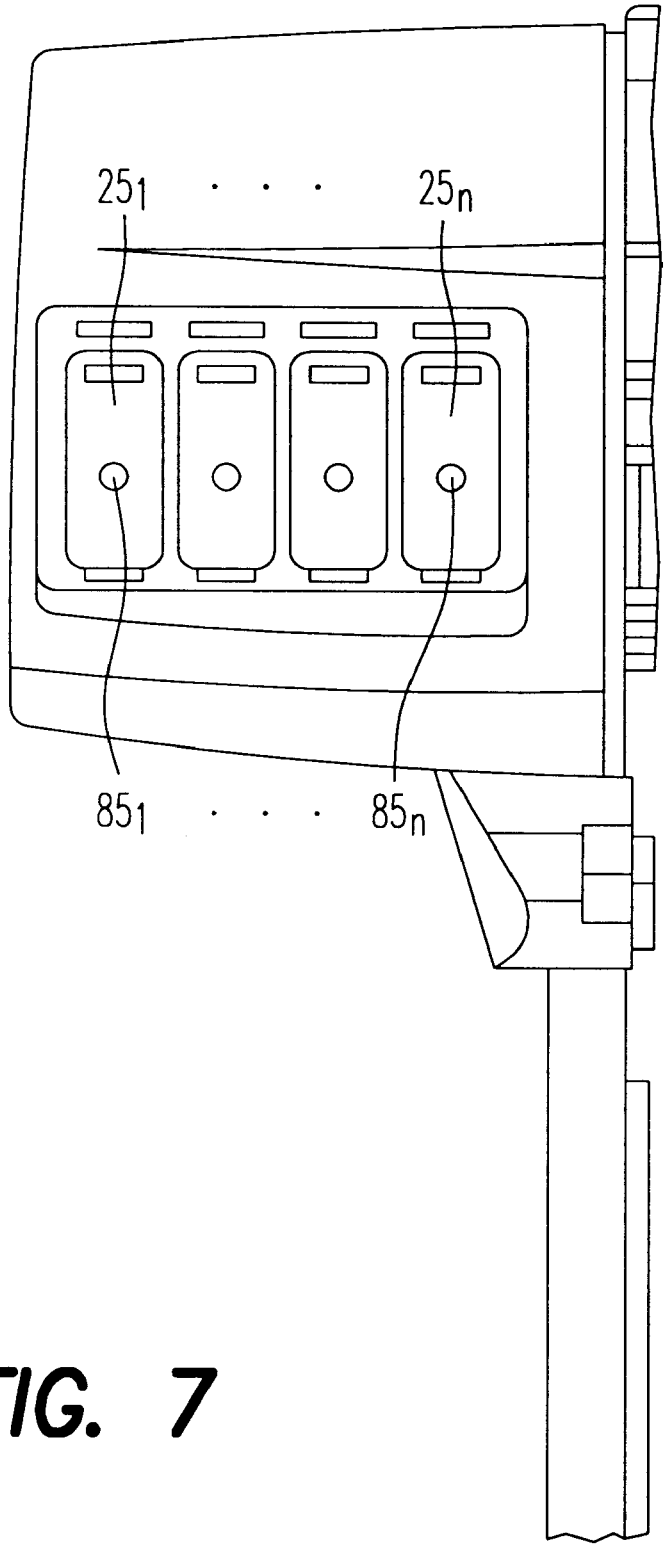
FIG. 7 shows an embodiment where the indicators are mounted on ink reservoirs.

FIG. 7 shows another example of a plotter component that includes an indicator in accordance with the teachings of the present invention.

FIG. 7 shows an enlarged view of reservoirs $\mathbf{25}_1$–$\mathbf{25}_n$ including indicators $\mathbf{85}_1$–$\mathbf{85}_n$. In this embodiment, indicators $\mathbf{85}_1$–$\mathbf{85}_n$ are bicolor LEDs that operate in a fashion similar to the LEDs $\mathbf{65}_1$–$\mathbf{65}_n$ shown in FIG. 3. The indicators $\mathbf{85}_1$–$\mathbf{85}_n$ on reservoirs $\mathbf{25}_1$–$\mathbf{25}_n$ are preferably controlled by the processor 55 and may emit different colors to indicate that service is required or that the reservoir is operating properly. Indicators $\mathbf{85}_1$–$\mathbf{85}_n$ each may also include more than one LED, and may light in a particular color, a set of colors, a pattern, may flash, or may otherwise illuminate to indicate that service is required for the corresponding reservoirs $\mathbf{25}_1$–$\mathbf{25}_n$. The indicators $\mathbf{85}_1$–$\mathbf{85}_n$ may also illuminate in a way to specify the specific type of service operation required. In another embodiment, indicators $\mathbf{85}_1$–$\mathbf{85}_n$ may be displays, for example, liquid crystal displays, for providing indications to user in accordance with the teachings herein.

Figure 8:
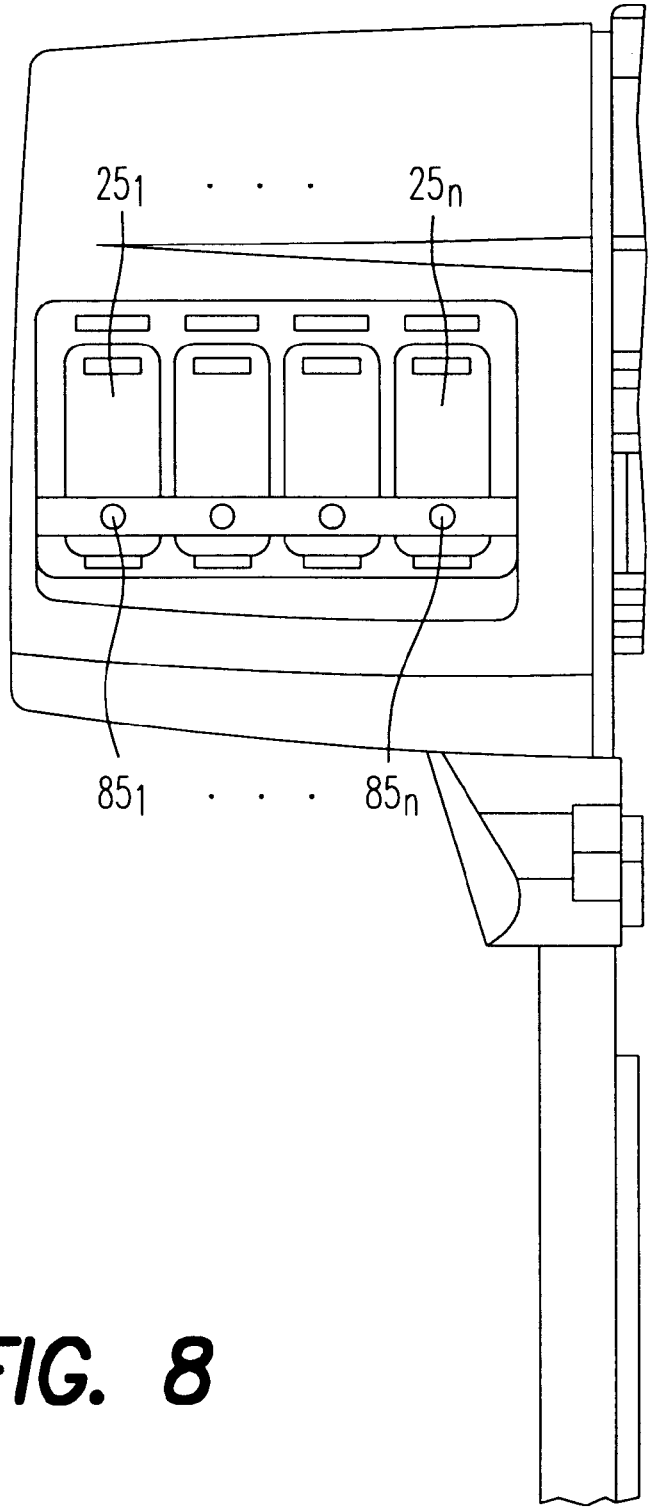
FIG. 8 shows an embodiment where the indicators are mounted on an ink reservoir frame.

FIG. 8 shows another embodiment where the indicators $\mathbf{85}_1$–$\mathbf{85}_n$ are mounted on an ink reservoir frame 92. The ink reservoir frame may serve as a support or mounting mechanism for the ink reservoirs $\mathbf{25}_1$–$\mathbf{25}_n$, and may also serve as a carrier for transporting the ink reservoirs $\mathbf{25}_1$–$\mathbf{25}_n$.

In still another embodiment, indicators $\mathbf{85}_1$–$\mathbf{85}_n$ each may be an audible indicator that operates in a manner similar to the indicators 80 shown in FIG. 5. The audible indication may not be limited to tones but may include any audible sound, including words or other vocal instructions.

Figure 9:
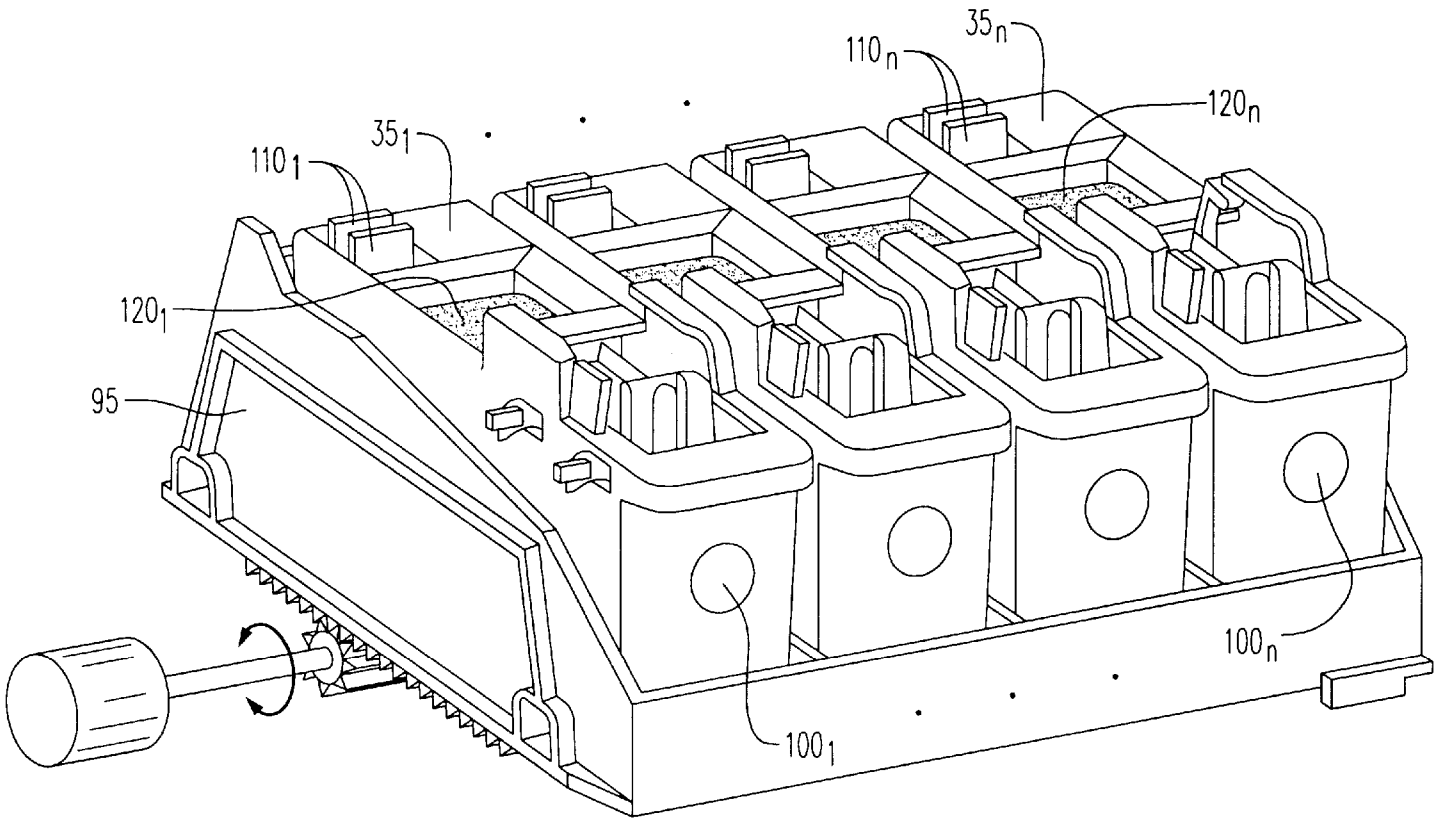
FIG. 9 shows an embodiment where the indicators are mounted on printhead cleaning devices.

FIG. 9 shows printhead cleaning devices $\mathbf{35}_1$–$\mathbf{35}_n$ mounted in a chassis 95. Each printhead cleaning device $\mathbf{35}_1$–$\mathbf{35}_n$ preferably includes a number of wipers $\mathbf{110}_1$–$\mathbf{110}_n$, a spittoon $\mathbf{120}_1$–$\mathbf{120}_n$, and an indicator $\mathbf{100}_1$–$\mathbf{100}_n$. As an example of a service operation that may be required for a printhead cleaning device $\mathbf{35}_1$, the processor 55 may record the number of times a printhead $\mathbf{30}_1$ passes over the printhead cleaning device $\mathbf{35}_1$ contacting wipers $\mathbf{110}_1$. After a specified number of "wipes," the processor 55 may indicate to the user that the wipers $\mathbf{110}_1$, or the whole printhead cleaning device $\mathbf{35}_1$, should be replaced. In another example, the spitton $\mathbf{120}_1$ is used to capture ink expelled by the printhead $\mathbf{30}_1$ during certain service operations. The processor 55 may count the number of drops expelled into the spittoon $\mathbf{120}_1$ and upon a determination that the spittoon $\mathbf{120}_1$ may be full, provide an indication to the user that the spittoon $\mathbf{120}_1$ should be emptied or the printhead cleaning device $\mathbf{35}_1$ should be replaced.

The indicators $\mathbf{100}_1$–$\mathbf{100}_n$ may include visible and audible indicators that service is required for a particular printhead cleaning device $\mathbf{35}_1$–$\mathbf{35}_n$ and may also indicate the particular service procedure to be performed, as described in the embodiments previously disclosed herein.

Figure 10:
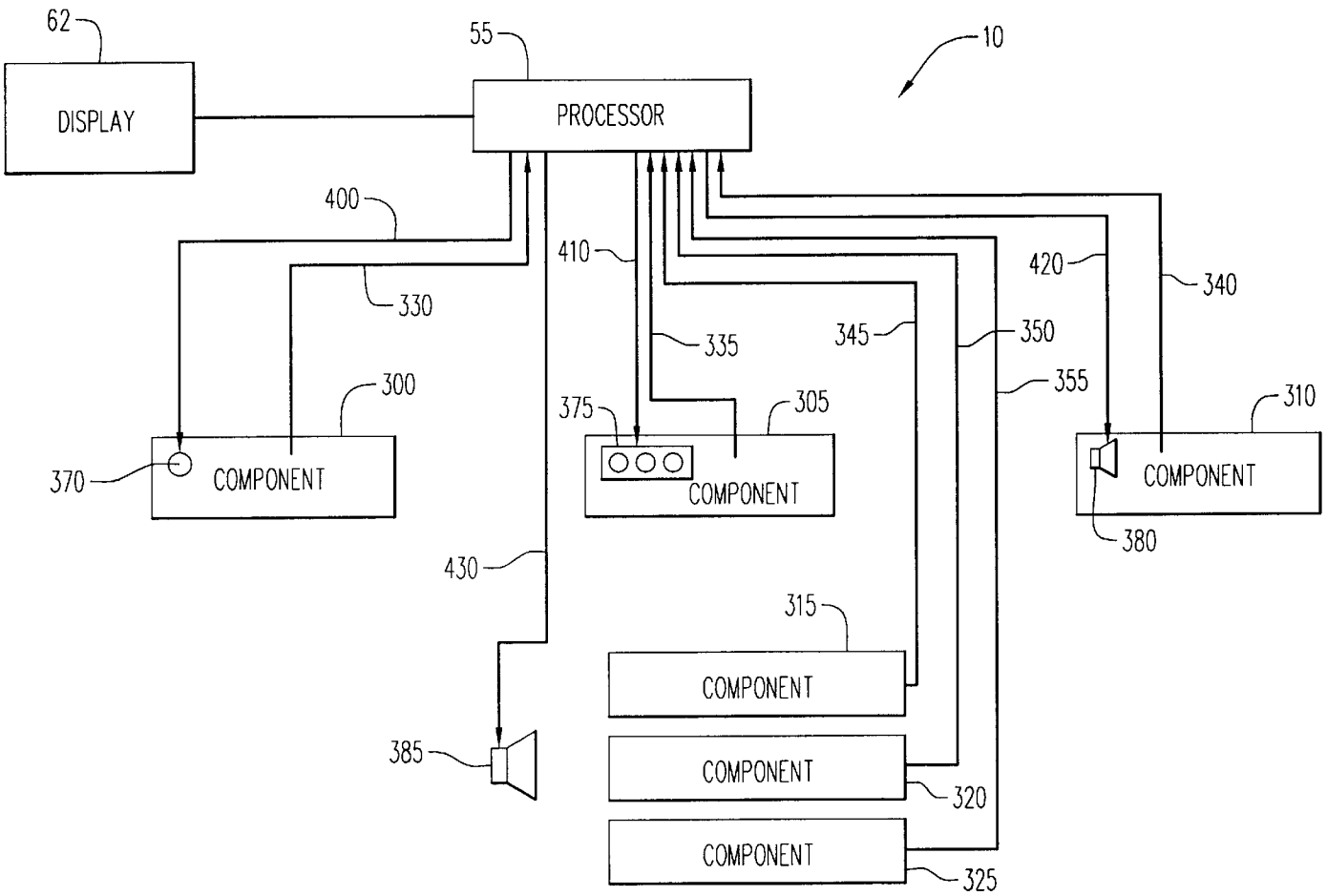
FIG. 10 is a block diagram showing examples of connections among some example components of the plotter having indicators in accordance with the teachings of the present invention.

FIG. 10 is a block diagram showing examples of connections among some example components of the plotter 10 having indicators in accordance with the teachings of the present invention. The processor 55 may be coupled to each component 300, 305, 310, 315, 320, 325 and receives the status of each component through status lines 330, 335, 340, 345, 350, 355. The processor is preferably coupled to indicators 370, 375, 380, and 385 and is capable of enabling them through indicator lines 400, 410, 420, 430. Upon determining that a condition requiring service for a particular component exists, the processor presents the information to the display 62 and enables the indicator for the particular component requiring service. Indicator 370 may be embodied as a bicolor LED for indicating a service condition for component 300, while indicator 375 may be embodied as a plurality of LEDs for indicating a service condition for component 305. Indicator 380 may be embodied as an audible device for indicating a service condition for component 310, while indicator 385 may be an audible device for indicating a service condition for each of components 315, 320, 325, individually or as a group.

While described in the context of a plotter 10, it should be understood that the present invention may be embodied in any mechanism that includes printing mechanisms and components that require service or other user intervention, where the information required to perform the service may not be readily observable by the user. For example, some of the printing mechanisms that may embody the present invention include desk top printers, portable printing units, copiers, cameras, video printers, facsimile machines, etc.

It should also be understood that while the various indicators have been described in the context of various visual and audible indicators, the present invention may include any indicating scheme that may be perceived or observed by a user when performing the service operations.

Thus, while the invention has been particularly shown and described with respect to preferred embodiments thereof, it will be understood by those skilled in the art that changes in form and details may be made therein without departing from its scope and spirit.

What is claimed is:

1. A printer having a processor and a display, said printer comprising:

a component comprising first circuitry for communicating a status of said component, wherein said processor, coupled to said component, further comprises second circuitry for determining a service requirement for said component in response to analyzing said status of said component; and an indicator, observable by a user performing said service at least when said display is not observable by said user, for indicating said service requirement to said user.

2. The printer of claim 1 wherein said component comprises said indicator.

3. The printer of claim 1 wherein said indicator is located in close proximity to said component.

4. The printer of claim 1 wherein said indicator comprises a visual indicator.

5. The printer of claim 4 wherein said indicator comprises an LED.

6. The printer of claim 4 wherein said indicator comprises a bicolor LED wherein a first LED color indicates a service requirement and a second LED color indicates the lack of a service requirement.

7. The printer of claim 4 wherein said indicator comprises a plurality of LEDs which are selectively illuminated to indicate a service requirement.

8. The printer of claim 1 wherein said indicator comprises an audible indicator.

9. The printer of claim 8 wherein said audible indicator emits at least one tone to indicate a service requirement.

10. The printer of claim 8 wherein said audible indicator emits vocal instructions to indicate a service requirement.

11. A method of servicing a printer having a main display and a processor, said method comprising the steps of:

determining a service requirement for a component of said printer;

indicating said service requirement on said main display; and indicating said service requirement to a user such that said indication is observable by said user when performing said service at least when said main display is not observable by said user.

12. The method of claim 11 wherein said component comprises said indication.

13. The method of claim 11 wherein said indication is located in close proximity to said component.

14. The method of claim 11 wherein said indication comprises a visual indication.

15. The method of claim 11 wherein said indication comprises an LED.

16. The method of claim 14 wherein said indication comprises a bicolor LED wherein a first LED color indicates a service requirement and a second LED color indicates the lack of a service requirement.

17. The method of claim 14 wherein said indication comprises a plurality of LEDs which illuminate in a pattern to indicate a service requirement.

18. The method of claim 11 wherein said indication comprises an audible indication.

19. The apparatus of claim 18 wherein said audible indication includes at least one tone which indicates a service requirement.

20. The apparatus of claim 18 wherein said audible indication includes vocal instructions to indicate a service requirement.

* * * * *